US005665935A

United States Patent [19]

Stromquist et al.

[11] Patent Number: 5,665,935

[45] Date of Patent: Sep. 9, 1997

[54] CAST PRIMER AND SMALL DIAMETER EXPLOSIVE COMPOSITION

[75] Inventors: Donald M. Stromquist, Salt Lake City; Boyd J. Wathen, Lehi, both of Utah

[73] Assignee: Dyno Nobel Inc., Salt Lake City, Utah

[21] Appl. No.: 200,819

[22] Filed: Feb. 22, 1994

Related U.S. Application Data

[63] Continuation of Ser. No. 790,340, Nov. 12, 1991, abandoned.

[51] Int. Cl.[6] ..... C06B 29/08

[52] U.S. Cl. ..... 149/83; 149/77

[58] Field of Search ..... 149/77, 83, 76, 149/19.6

[56] References Cited

U.S. PATENT DOCUMENTS

| | | | |
|---|---|---|---|
| 3,148,097 | 9/1964 | Gilman | 144/83 |
| 3,242,020 | 3/1966 | Atkins et al. | 149/196 |
| 3,390,029 | 6/1968 | Preckel | 149/76 |
| 3,395,056 | 7/1968 | Bronstein, Jr. | 149/44 |
| 3,617,402 | 11/1971 | Knight, Jr. et al. . | |
| 3,684,594 | 8/1972 | Evans | 149/38 |
| 3,695,948 | 10/1972 | Clark | 149/2 |
| 3,730,790 | 5/1973 | Falconer et al. | 149/76 |
| 3,765,967 | 10/1973 | Funk et al. . | |
| 3,846,195 | 11/1974 | Zimmerman et al. | 149/196 |
| 3,864,177 | 2/1975 | Klunsch et al. | 149/76 |
| 3,985,593 | 10/1976 | Machacek | 149/78 |
| 3,993,514 | 11/1976 | Pacanowsky et al. | 149/76 |
| 4,163,681 | 8/1979 | Rothenstein et al. | 149/11 |
| 4,207,125 | 6/1980 | Grant | 149/83 |
| 4,600,451 | 7/1986 | Jessop et al. | 149/196 |
| 4,693,765 | 9/1987 | Stromquist et al. . | |
| 5,004,776 | 4/1991 | Tadenuma et al. | 524/377 |
| 5,007,973 | 4/1991 | Trapp et al. | 149/2 |

FOREIGN PATENT DOCUMENTS

| | | |
|---|---|---|
| 535971 | 4/1941 | United Kingdom . |
| 907611 | 10/1962 | United Kingdom . |

OTHER PUBLICATIONS

6001 Chemical Abstracts 108 (1988) Apr., No. 14, Columbus, Ohio.

*Primary Examiner*—Edward A. Miller
*Attorney, Agent, or Firm*—Mallinckrodt & Mallinckrodt

[57] ABSTRACT

A solid explosive composition is made by curing a mixture of a 20–50% by weight of a liquid matrix, 50–80% by weight of an essentially anhydrous inorganic chlorate or perchlorate salt, and 0–15% of a nitrate salt after transferring said mixture to a mold. The matrix can include 50–84% by weight of a non-explosive liquid fuel selected from the group consisting of polyhydric alcohols, lower aliphatic alcohols, ketones, and hydrocarbons; 0–15% by weight of a nitrate oxidizer salt; 0–15% by weight water; 0–15% by weight of a thickener; and 0–5% by weight of an acid.

20 Claims, No Drawings

CAST PRIMER AND SMALL DIAMETER EXPLOSIVE COMPOSITION

This application is a continuation of application Ser. No. 07/790,340, filed Nov. 12, 1991, now abandoned.

BACKGROUND OF THE INVENTION

1. Field

The invention is in the field of explosives of the solid cast primer or booster explosive type as well as explosives in general of small diameter.

2. State of the Art

With the advent of ammonium nitrate and fuel oil mixtures, known as ANFO, into the explosives industry in the early 1950's, and of other lesser or more sensitive explosive mixtures since that time, ways were sought to develop an initiator for these materials in surface and underground blasting. As a result, the cast primer or booster was developed. The cast primer is made from self-explosives such as trinitrotoluene [TNT], cyclotrimethylenetrinitramine [RDX], pentaerythritol tetranitrate [PETN], and mixtures thereof such as Composition B which contains about 60% RDX, 40% TNT, and some wax as a desensitizer. The first cast products were made with a variety of sensitive cores such as PETN or a coiled detonating fuse.

The known and presently used process for making such cast primers or boosters consists of melting the above-mentioned sensitive explosives or combinations thereof, often at temperatures approaching 100 degrees Centigrade or higher, and casting the melted explosive into molds. The greatest hazard posed by the operation is the risk that the temperature control means may fail, and thus, the explosive may reach decomposition temperature and explode. Aside from this grave risk, the process is inherently dangerous in that self-explosives are being handled which are subject to shock detonation even at lower temperatures. Furthermore, in handling the cast products an extremely sensitive dust may be produced which is even more hazardous than the cast primer itself.

There are disadvantages other than the risk of explosion. The materials used are expensive and some are not available from domestic sources. The molds must, of course, be able to withstand the heat of the melted explosive. Nevertheless, such primers are widely used because they have the advantage of being relatively water resistant. Other combinations of primers and boosters based on water gel and or emulsion-based compositions may display only some water resistance or no water resistance at all.

In the past, there have been attempts to formulate sensitive slurry or emulsion type explosive compositions using aqueous solutions of inorganic chlorate and perchlorate salts, i.e., salts of either the chlorate ($ClO_3$) or perchlorate ($ClO_4$) ions. These inorganic chlorate and perchlorate slurries and emulsions have serious drawbacks. Their density has to be carefully controlled by using gases (as small bubbles), micro-balloons or similar inert, insensitive, materials that complicate processing and detract from the energy of the primers.

It is an object of the present invention to make a castable primer explosive to maximize borehole pressure (which is a function of both velocity and density) that uses sensitive inorganic chlorate and perchlorate salts, especially the relatively shock-insensitive sodium perchlorate, instead of self-explosives.

It is another object of the invention to make a cast primer or booster at ambient temperatures and thus avoid the hazard of working with explosives at elevated temperatures.

SUMMARY OF THE INVENTION

According to the invention, a castable primer explosive composition is made up by combining 20–50% by weight of a liquid matrix and 50–80% of a dry insensitive oxidizer salt or mixture of oxidizer salts which primarily comprises a dry inorganic chlorate or perchlorate salt. The mixture is hereinafter referred to as matrix-dry salt mixture. It was discovered by the inventors, that such a mixture cures to a solid product if it contains a substantial amount of a dry perchlorate or chlorate salt. Curing takes place rather quickly, but, before it does, the matrix-dry salt mixture can be pressed, poured, or cast into a mold. The molded product can be detonated with about an 8 gram pentolite detonator, or, preferred embodiments containing higher amounts of inorganic perchlorates can be detonated with a No. 6 or No. 8 blasting cap.

The matrix can include: 50–84% by weight of a non-explosive liquid fuel, preferably a polyhydric glycol such as diethylene glycol; 0–15% by weight of an inorganic nitrate oxidizer salt, such as ammonium nitrate, potassium nitrate, sodium nitrate, or calcium nitrate; 0–15% percent by weight water; 0–15% by weight of a water-soluble polymer thickener such as guar gum; and 0–5% weight of an acid such as glacial acetic acid. Except for the water soluble polymer thickeners, the preferred fuel is a liquid, water soluble, oxygenated organic material of low volatility. Examples of the preferred fuel include polyhydric alcohols such as glycerol, ethylene glycol, diethylene glycol, triethylene glycol, tetraethylene glycol, propylene glycol, dipropylene glycol, tripropylene glycol, and mixtures thereof. Also preferred are still bottoms remaining from the purification of the above because of their low cost. Depending on their composition, still bottoms can be used alone or in combination with any of the above polyhydric alcohols. As an additional option the matrix can include a cross-linking agent such as potassium pyroantimonate.

The final mixture includes 50–80% by weight of a dry, inorganic chlorate or perchlorate salt. Sodium perchlorate is preferred but sodium chlorate, ammonium chlorate, and ammonium perchlorate can be used. The final mixture can also include an additional 0–15% by weight of a dry nitrate oxidizer salt such as ammonium nitrate, calcium nitrate, sodium nitrate, potassium nitrate, or mixtures thereof in addition to any nitrate salt that may be included in the matrix. Thus, as the price and availability of the ingredients vary, the primers can be formulated to minimize cost.

A rough guide to formulating the primers of this invention is to proportion the inorganic oxidizers and the organic fuels so that all of the hydrogen atoms in the formulations are converted to water and all the oxygen atoms in the formulations are converted to carbon monoxide. However, wide departures from this guide yield primers with good mechanical properties that detonate reliably with a No. 8 blasting cap.

Initially, upon mixing the liquid matrix with the dry, inorganic oxidizer salt or salts, the composition forms a pourable or pumpable mixture. On standing anywhere from 20 minutes to several hours depending on the formulation and temperature, the mixture cures to a solid, waxy mass with good mechanical properties. The cure mechanism is not well understood, especially with those formulations in which the water soluble polymer is not deliberately crosslinked, but may involve formation of alcoholates, including cyclic glycolates and hydrates of the dry inorganic salts.

This method of making a solid, castable, explosive is a safety improvement over prior art cast primers, especially when sodium perchlorate is employed, because none of the starting materials is a self explosive and it is not necessary to heat the mixture in order to obtain an extrudable, pourable, or pumpable composition. In fact, a mildly exothermic reaction takes place in making up the matrix. Cooling the matrix before adding the dry product can keep the mixture pourable for a longer period of time, i.e., extend the pot life. The resulting cast primer is economical, heat resistant, modestly water resistant, and has an explosive strength equivalent to that of prior art cast primers.

Another distinct advantage of the primers of the present invention over the prior art is the fact that their performance in terms of shock wave velocity improves as their density increases. The optimum density for certain formulations is 1.80 grams/cc. Surprisingly, formulations show diminished activity and performance down to 1.50 grams/cc.

This is in direct contrast with many primers which give reduced velocity as the density increases. For example, micro-balloons or air entrapment must be used to lower density in order to make primers from materials such as ANFO emulsions or slurries. Also, the self-explosives usually require blending to give an optimum density of about 1.5 to 1.6 grams/cc.

Of course, the objective is to maximize borehole pressure which is a function of both velocity and density.

DETAILED DESCRIPTION OF THE ILLUSTRATED EMBODIMENT

The solid explosive of the invention is made from a mixture of a liquid matrix with a dry oxidizer salt or mixture of dry oxidizer salts, i.e., a matrix-dry salt mixture. After combining the matrix-dry salt mixture, it is transferred to the primer container or mold. The molded mixture cures to a solid product in about two hours more or less depending on temperature, the fluidity of the mixture when made, and the amount of dry salt used.

The matrix can include: 50–84% by weight of a non-explosive liquid fuel such as diethylene glycol, other polyhydric glycols, lower aliphatic alcohols, ketones, and hydrocarbons such as fuel oil, or mixtures thereof; 0–15% by weight of water; 0–15% by weight of an inorganic nitrate salt such as calcium nitrate, ammonium nitrate, or sodium nitrate; 0–15% of a water soluble polymeric thickener such as guar gum; and 0–5% by weight of an acid such as glacial acetic acid.

The oxidizer salt is an inorganic chlorate or perchlorate salt such as ammonium chlorate, sodium chlorate, ammonium perchlorate, sodium perchlorate, and mixtures thereof. A substantial portion of the oxidizer salt must be supplied in a dry form in order to obtain primers with good mechanical properties. The dry oxidizer salt can include lesser amounts of dry nitrate salts. The matrix-dry salt mixture can contain 50–80% by weight of a dry inorganic chlorate or perchlorate, 0–15% by weight of a dry nitrate salt; and 20–50% by weight matrix.

Sodium perchlorate is the preferred salt from a safety standpoint. Ammonium perchlorate is also quite safe to handle but is much more expensive. These salts yield a final product that is much safer to handle.

The higher the amount of perchlorate, the greater the density and ease with which the primers are detonated. In a first embodiment of the invention, the matrix has the following formula:

| | |
|---|---|
| Diethylene Glycol | 75% |
| Water | 10% |
| Calcium Nitrate | 12.4% |
| Guar Gum | 2.5% |
| Glacial Acetic Acid | 0.1% |

In making up the matrix, the calcium nitrate is first dissolved in water. This solution is added to the non-explosive liquid fuel, i.e., diethylene glycol, wherein a mild exothermic reaction takes place. It is desirable to keep the temperature of the matrix low or to lower it after the exothermic reaction. Keeping the temperature low extends the time in which the freshly made-up matrix-dry salt mixture remains transferable.

After adding the aqueous solution containing the nitrate to the non-explosive liquid fuel, guar gum is then suspended in an aliquot of the liquid fuel, water, and the nitrate salt. Once suspended it is added to the liquid fuel-water-nitrate mixture.

The matrix can include part of the overall amount of sodium perchlorate as an aqueous solution thereof such as is available from commercial sources. Of course, if added to the matrix as a solution, the amount of water added as such is reduced to keep the overall amount of water within an acceptable range.

The glacial acetic acid is added next and mixed. Glacial acetic acid is a viscosity enhancer in the guar system. The matrix is now ready to be mixed with the dry salt. The matrix is thin and watery on being made. In other words it is of low viscosity before the guar dissolves. It thickens with time as the guar dissolves. On standing for several hours or overnight it becomes thick and honey-like. However, there is no change or difference in the final product whether the matrix is used fresh or aged.

Dry sodium perchlorate salt was added to the matrix to make up a mixture that was 67% by weight sodium perchlorate and 33% by weight matrix. The sodium perchlorate used in this example and the other examples below was essentially anhydrous, i.e, less than a percent or so water. However, it is believed that since some water is present in acceptable formulations that it is not necessary that the dry salt be essentially anhydrous and that perhaps even the monohydrate is dry enough to be used to form the fluid liquid matrix-dry salt mixture.

It was discovered by the inventors, that the fluid mixture is not sensitive to a No. 8 blasting cap while the finished product that hardens after about two hours is sensitive to a No. 8 blasting cap. This greatly adds to the margin of safety in handling the mixture. The final product had a density of 1.49 grams/cc. A one pound charge was detonated on a steel plate of ¾ inch thickness and blasted a hole in the plate.

In a second embodiment, the matrix has the following formula:

| | |
|---|---|
| Aqueous Solution of Sodium Perchlorate (61%) | 30% |
| Calcium Nitrate | 10% |
| Diethylene Glycol | 57% |
| Guar Gum | 2.9% |
| Glacial Acetic Acid | .1% |

Dry sodium perchlorate was added to the matrix to make a final product that was 60% dry sodium perchlorate and 40% matrix. The final product had a density of 1.40 grams/cc. A one pound charge was sensitive to a No. 8 blasting cap.

The charge was detonated on a ¾ inch thick steel witness plate and caused spalling of the plate.

In a third embodiment, the matrix had the following formula:

| | |
|---|---|
| Aqueous Solution of Sodium Perchlorate (61%) | 20% |
| Calcium Nitrate | 10% |
| Diethylene Glycol | 67% |
| Guar Gum | 3% |
| Glacial Acetic Acid | .1% |

Dry sodium perchlorate was added to the matrix to make a final product that was 65% dry sodium perchlorate and 35% matrix. The final product had a density of 1.40 grams/cc. A one pound charge detonated with a No. 8 blasting cap. The charge was detonated on a ¾ inch thick steel witness plate and caused spalling of the plate.

In a fourth embodiment, the matrix had the following formula:

| | |
|---|---|
| Aqueous Solution of Sodium Perchlorate (61%) | 35% |
| Calcium Nitrate | 10% |
| Diethylene Glycol | 53.5% |
| Guar Gum | 1.5% |

Dry sodium perchlorate was added to the matrix to make a final product that was 55% dry sodium perchlorate and 45% matrix. The final product had a density of 1.40 grams/cc. A one pound charge detonated with a No. 8 blasting cap.

In a fifth embodiment, the matrix had the following formula:

| | |
|---|---|
| Aqueous Solution of Sodium Perchlorate (61%) | 25% |
| Diethylene Glycol | 73% |
| Guar Gum | 2% |

Dry sodium perchlorate was added to the matrix to make a final product that was 62% dry sodium perchlorate and 38% matrix. The final product had a density of 1.54 grams/cc. A one pound charge was sensitive to a No. 8 blasting cap. The charge was detonated on a ¾ inch thick steel witness plate and blasted a hole in the plate.

In sixth, seventh, eighth, and ninth embodiments of the invention, the matrix had the following formula:

| | |
|---|---|
| Diethylene Glycol | 74% |
| Water | 11% |
| Calcium Nitrate | 12% |
| Guar Gum | 2% |
| Glacial Acetic Acid | 1% |

In the sixth embodiment using the above matrix, dry sodium perchlorate was added to the matrix to make a final product that was 68% dry sodium perchlorate and 32% matrix. A 250 gram charge was sensitive to a No. 8 blasting cap. The charge was detonated on a ¾ inch thick steel witness plate and blasted a hole in the plate.

In the seventh embodiment using the above matrix, dry sodium perchlorate was added to the matrix to make a final product that was 53% dry sodium perchlorate and 32% matrix. The remaining 15% of the final product was made up with additional calcium nitrate. A 250 gram charge was sensitive to a No. 8 blasting cap.

In the eighth embodiment using the above matrix, dry sodium perchlorate was added to the matrix to make a final product that was 53% dry sodium perchlorate, 32% matrix. The remaining 15% of the final product was made up with sodium nitrate. A 250 gram charge was sensitive to a No. 8 blasting cap.

In the ninth embodiment using the above matrix, dry sodium perchlorate was added to the matrix to make a final product that was 60.5% dry sodium perchlorate and 32% matrix. The remaining 7.5% of the final product was made up with additional sodium nitrate. The final product had a density of 1.72 grams/cc. A one pound charge was sensitive to a No. 8 blasting cap. The charge was detonated on a ¾ inch thick steel plate and blasted a ½ to ¾ inch hole in the plate.

In a tenth and eleventh embodiment of the invention, the matrix had the following formula:

| | |
|---|---|
| Diethylene Glycol | 84% |
| Water | 12.5% |
| Guar Gum | 2.4% |
| Glacial Acetic Acid | 1.1% |

In the tenth embodiment using the above matrix, dry sodium perchlorate was added to the matrix to make a final product that was 64.5% dry sodium perchlorate and 28% matrix. The remaining 7.5% of the final product was made up with calcium nitrate. The final product had a density of 1.67 grams/cc. A one pound charge was sensitive to a No. 8 blasting cap.

In the eleventh embodiment using the above matrix, dry sodium perchlorate was added to the matrix to make a final product that was 53% dry sodium perchlorate and 32% matrix. The remaining 15% of the final product was made up with calcium nitrate. The final product had a density of 1.64 grams/cc. A one pound charge was sensitive to a No. 8 blasting cap.

In a twelfth embodiment, the matrix has the following formula:

| | |
|---|---|
| Diethylene Glycol | 75% |
| Water | 11.5% |
| Calcium Nitrate | 13.5% |

In the twelfth embodiment using the above matrix, dry sodium perchlorate was added to the matrix to make a final product that was 58% dry sodium perchlorate and 32% matrix. The remaining 10% was sodium nitrate. The final product had a density of 1.75 to 1.80 grams/cc with good mechanical properties. A one pound charge was sensitive to a No. 8 blasting cap and blasted a hole 1.0 to 1.5 inches in diameter in a ¾ inch thick steel witness plate.

Tests on the various examples showed that velocity ranged from 19,000 to 23,000 ft/sec depending on the formulation for the various final products.

Whereas this invention is here illustrated and described with reference to embodiments thereof presently contemplated as the best modes of carrying out such invention in actual practice, it is to be understood that various changes may be made in adapting the invention to different embodiments without departing from the broader inventive concepts disclosed herein and comprehended by the claims that follow.

We claim:

1. A cast, solid explosive composition for use as a primer and a small diameter explosive, consisting essentially of a cast, solid, cured initially pourable mixture of at least one liquid water-soluble polyhydric alcohol of low volatility and dry sodium perchlorate oxidizer salt;

wherein the cast, cured, solid composition can be detonated with the explosive power of a No. 8 blasting cap.

2. A cast, solid explosive composition for use as a primer and a small diameter explosive, consisting essentially of a cast, solid, cured initially pourable mixture of:

(a) a matrix consisting essentially of at least one liquid water-soluble polyhydric alcohol of low volatility and water; and (b) dry sodium perchlorate oxidizer salt;

wherein the cast, cured, solid composition can be detonated with the explosive power of a No. 8 blasting cap.

3. A cast, solid explosive composition for use as a primer and a small diameter explosive, consisting essentially of a cast, solid, cured initially pourable mixture of:

(a) a matrix consisting essentially of at least one liquid, water-soluble polyhydric alcohol of low volatility and a thickener; and (b) dry sodium perchlorate oxidizer salt;

wherein the cast, cured, solid composition can be detonated with the explosive power of a No. 8 blasting cap.

4. A cast, solid explosive composition for use as a primer and a small diameter explosive, consisting essentially of a cast, solid, cured initially pourable mixture of:

(a) a matrix consisting essentially of at least one liquid, water-soluble polyhydric alcohol of low volatility, and a solution of water and at least one dissolved oxidizer salt selected from the group consisting of a nitrate, a chlorate, a perchlorate, and mixtures thereof; and (b) dry sodium perchlorate oxidizer salt;

wherein the cast, cured, solid composition can be detonated with the explosive power of a No. 8 blasting cap.

5. A cast, solid explosive composition for use as a primer and a small diameter explosive, consisting essentially of a cast, solid, cured initially pourable mixture of:

(a) a matrix consisting essentially of at least one liquid, water-soluble polyhydric alcohol of low volatility, a thickener, and a solution of water and at least one dissolved oxidizer salt selected from the group consisting of a nitrate, a chlorate, a perchlorate, and mixtures thereof; and (b) dry sodium perchlorate oxidizer salt;

wherein the cast, cured, solid composition can be detonated with the explosive power of a No. 8 blasting cap.

6. A composition of claim 1, 2, 3, 4, or 5, wherein the liquid, water-soluble polyhydric alcohol of low volatility is selected from the group consisting of polyhydric glycols, lower aliphatic alcohols, and mixtures thereof.

7. A composition of claim 1, 2, 3, 4, or 5, wherein the liquid, water-soluble polyhydric alcohol of low volatility is selected from the group consisting of unsubstituted diethylene glycol, substituted diethylene glycol, derivatives of diethylene glycol and mixtures thereof.

8. A cast, solid explosive composition for use as a primer and a small diameter explosive, consisting essentially of a cast, solid, cured initially pourable mixture of diethylene glycol and dry sodium perchlorate;

wherein the cast, cured, solid composition can be detonated with the explosive power of a No. 8 blasting cap.

9. A cast, solid explosive composition for use as a primer and a small diameter explosive, consisting essentially of a cast, solid, cured initially pourable mixture of:

(a) a matrix consisting essentially of diethylene glycol, and water; and (b) dry sodium perchlorate;

wherein the cast, cured, solid composition can be detonated with the explosive power of a No. 8 blasting cap.

10. A cast, solid explosive composition for use as a primer and a small diameter explosive, consisting essentially of a cast, solid, cured initially pourable mixture of:

(a) a matrix consisting essentially of diethylene glycol, and a thickener; and (b) dry sodium perchlorate;

wherein the cast, cured, solid composition can be detonated with the explosive power of a No. 8 blasting cap.

11. A cast, solid explosive composition for use as a primer and a small diameter explosive, consisting essentially of a cast, solid, cured initially pourable mixture of:

(a) a matrix consisting essentially of diethylene glycol, and a solution of water and at least one dissolved oxidizer salt selected from the group consisting of a nitrate, a chlorate, a perchlorate and mixtures thereof; and (b) dry sodium perchlorate;

wherein the cast, cured, solid composition, can be detonated with the explosive power of a No. 8 blasting cap.

12. A cast, solid explosive composition for use as a primer and a small diameter explosive, consisting essentially of a cast, solid, cured initially pourable mixture of:

a. a matrix consisting essentially of diethylene glycol, a thickener, and a solution of water and at least one dissolved oxidizer salt selected from the group consisting of a nitrate, a chlorate, a perchlorate and mixtures thereof; and b. dry sodium perchlorate;

wherein the cast, cured, solid composition can be detonated with the explosive power of a No. 8 blasting cap.

13. A composition according to claim 9, wherein diethylene glycol and water together make up between 20% and 50% of the composition.

14. A composition according to claim 8, wherein sodium perchlorate makes up between 50% and 80% of the explosive composition.

15. A composition according to claim 8, wherein diethylene glycol makes up at least 10% of the explosive composition.

16. A composition according to claim 8, wherein some of the sodium perchlorate is present as hydrates and alcoholates.

17. A composition of claims 1, 2, 3, 4, or 5, wherein the sodium perchlorate oxidizer salt makes up between 50% and 80% of the solid explosive composition.

18. A composition of claims 1, 2, 3, 4, or 5, wherein the liquid, water-soluble polyhydric alcohol of low volatility makes up at least 10% of the explosive composition.

19. A composition of claim 2, wherein the liquid, water-soluble polyhydric alcohol of low volatility and water together make up between 20% and 50% of the composition.

20. A composition of claims 4 or 5, wherein the matrix makes up between 20% and 50% of the composition.

* * * * *